US008006880B2

(12) United States Patent
Tanaka et al.

(10) Patent No.: US 8,006,880 B2
(45) Date of Patent: Aug. 30, 2011

(54) GAS COMBUSTION TYPE DRIVING TOOL

(75) Inventors: Hiroshi Tanaka, Tokyo (JP); Hajime Takemura, Tokyo (JP); Junichi Tamura, Tokyo (JP); Katsuhiko Murayama, Tokyo (JP)

(73) Assignee: Max Co., Ltd, Tokyo (JP)

( * ) Notice: Subject to any disclaimer, the term of this patent is extended or adjusted under 35 U.S.C. 154(b) by 50 days.

(21) Appl. No.: 12/517,647

(22) PCT Filed: Dec. 4, 2007

(86) PCT No.: PCT/JP2007/073420

§ 371 (c)(1),
(2), (4) Date: Jun. 4, 2009

(87) PCT Pub. No.: WO2008/069215

PCT Pub. Date: Jun. 12, 2008

(65) Prior Publication Data

US 2010/0032467 A1 Feb. 11, 2010

(30) Foreign Application Priority Data

Dec. 5, 2006 (JP) ..... 2006-328290

(51) Int. Cl.
*B25C 1/08* (2006.01)

(52) U.S. Cl. ..... 227/10; 227/8; 227/9

(58) Field of Classification Search ..... 227/10, 227/8, 9

See application file for complete search history.

(56) References Cited

U.S. PATENT DOCUMENTS

| | | | | |
|---|---|---|---|---|
| 3,012,549 | A * | 12/1961 | Bard et al. | 173/209 |
| 3,967,771 | A * | 7/1976 | Smith | 227/10 |
| 4,403,722 | A * | 9/1983 | Nikolich | 227/8 |
| 4,483,473 | A * | 11/1984 | Wagdy | 227/8 |
| 5,860,580 | A * | 1/1999 | Velan et al. | 227/10 |
| 6,886,730 | B2 * | 5/2005 | Fujisawa et al. | 227/8 |
| 7,175,063 | B2 * | 2/2007 | Osuga et al. | 227/8 |
| 7,308,996 | B2 * | 12/2007 | Tanaka et al. | 227/10 |
| 7,556,182 | B2 * | 7/2009 | Murayama et al. | 227/10 |
| 7,686,197 | B2 * | 3/2010 | Kosuge et al. | 227/10 |
| 2005/0001004 | A1 * | 1/2005 | Fujisawa et al. | 227/10 |
| 2005/0173485 | A1 | 8/2005 | Moeller et al. | |
| 2005/0173487 | A1 | 8/2005 | Moeller et al. | |

FOREIGN PATENT DOCUMENTS

| | | |
|---|---|---|
| EP | 1 391 270 A1 | 2/2004 |
| JP | 7-156076 | 6/1995 |
| JP | 2004-074296 | 3/2004 |
| JP | 2005-329533 | 12/2005 |
| JP | 2006-315102 | 11/2006 |

* cited by examiner

*Primary Examiner* — Brian D Nash

(74) *Attorney, Agent, or Firm* — Drinker Biddle & Reath LLP

(57) ABSTRACT

A gas combustion type driving tool is provided with two modes including: a contact mode in which a contact arm 15 is pressed against a workpiece P into which a nail is to be driven and the nail is driven under a condition that a trigger lever 16 is pulled; and a trigger mode in which the trigger lever 16 is pulled and the nail is driven under a condition that the contact arm 15 is pressed against the workpiece P. In either mode, a nail driving can be continuously executed.

3 Claims, 8 Drawing Sheets

SW1
SW2
13
14
15
15a
15b
16
18
20
21
5
4
9
10
11
6
P 13
5
14
10
9
20
SW2
16

SW1
SW2
15 b
20
18
21
13
14
5
10
9
6
15
16
P

SW1
SW2
15 b
20
21
13
5
14
10
9
6
P
15
16
18

GAS COMBUSTION TYPE DRIVING TOOL

TECHNICAL FIELD

The present invention relates to a gas combustion type driving tool. More particularly, the present invention relates to a gas combustion type driving tool having a function of being capable of driving fasteners in succession and also capable of singly driving fasteners, either in a case where the fasteners are driven when a contact arm is pressed against a workpiece into which the fasteners are driven under a condition that a trigger lever is pulled or in a case where the fasteners are driven when the trigger lever is pulled under a condition that the contact arm is pressed against the workpiece.

BACKGROUND ART

In a conventional gas combustion type driving tool, when a contact arm is pressed against a workpiece into which nails are driven, a combustion chamber is closed and fuel is injected into the combustion chamber. Then, when a trigger lever is pulled, mixed gas is ignited and burned. By a pressure of a combustion gas explosively burning, a piston is driven. Therefore, by a driver integrally connected to the piston, a nail is driven into the workpiece. In this combustion type driving tool, each time a driving motion is executed, the trigger lever must be operated being pulled. Therefore, a working efficiency can not be enhanced. In order to solve the above problems, a driving tool is proposed in which nails can be continuously driven when the contact arm is pressed against the workpiece while the trigger lever is being pulled. Concerning this tool, for example, refer to JP-A-2004-074296. In this tool, when the contact arm is pressed against the workpiece while the trigger lever is being pulled, the mixed gas is ignited and the piston is driven.

However, in the gas combustion type driving tool disclosed in JP-A-2004-074296, a combustion frame (which corresponds to a movable sleeve of embodiments of the present application) is connected to a push lever (which corresponds to a contact arm of the embodiments of the present application). When the push lever is pressed against the workpiece, the combustion frame is raised and the combustion chamber is closed. Therefore, although it is possible to continuously drive the nails, after the push lever has been pressed against the workpiece, various preparations must be made such as a closure of the combustion chamber, an injection of the fuel gas and a generation of the mixed gas. Therefore, it is always necessary to take a preparation time after the push lever has been pressed against the workpiece. Further, in order to open the combustion chamber, it is necessary to release the push lever from the workpiece each time the combustion chamber is opened. Therefore, although the nails can be continuously driven, much time is required for the preparation work to ignite the mixed gas.

DISCLOSURE OF INVENTION

One or more embodiments of the invention provide a gas combustion type driving tool having a high working efficiency and an excellent operating property, in which: a combustion chamber is opened and closed being not restricted by pressing and releasing a contact arm against a workpiece into which nails are driven; the nails can be continuously driven while a trigger lever is being pulled; the nails can be continuously driven while the contact arm is being pressed against the workpiece; and the nails can be continuously and singly driven irrespective of an operation order of the trigger lever and the contact arm.

In accordance with one or more embodiments of the invention, in a gas combustion type driving tool for driving fasteners into a workpiece when a piston is driven by the pressure of combustion gas which is generated when mixed gas in a combustion chamber is ignited and burned, when a trigger lever is pulled, the combustion chamber is closed, fuel gas is injected, air in the combustion chamber and fuel gas are stirred and mixed gas is generated, and when a contact arm is pressed against the workpiece the mixed gas is ignited, and after the mixed gas is ignited and a predetermined period of time has passed, the combustion chamber is opened and the combustion gas is exhausted.

In the gas combustion type driving tool described above, since the combustion chamber is opened after the predetermined period of time has passed, it is possible to realize a continuous driving motion, an efficiency of which is high, in which the trigger lever is kept being pulled.

In accordance with one or more embodiments of the invention, a piston is driven by the pressure of combustion gas generated when mixed gas in a combustion chamber is ignited and burned and a fastener is driven, and the gas combustion type driving tool is provided with two modes including: a contact mode in which the fastener is driven when a contact arm is pressed against the workpiece under a condition that a trigger lever is being pulled; and a trigger mode in which the fastener is driven when the trigger lever is pulled under a condition that the contact arm is being pressed against the workpiece. In the contact mode, when the trigger lever is pulled, the combustion chamber is closed, the fuel gas is injected, the air in the combustion chamber and the fuel gas are stirred so that the mixed gas is generated, and when the contact arm is pressed against the workpiece, the mixed gas is ignited. In the trigger mode, when the contact arm is pressed against the workpiece, the combustion chamber is closed, the fuel gas is injected, the air in the combustion chamber and the fuel gas are stirred so that the mixed gas is generated, and when the trigger lever is pulled, the mixed gas is ignited. The combustion chamber is opened and combustion gas is exhausted when a predetermined period of time has passed after an ignition of the mixed gas.

In the gas combustion type driving tool described above, it is possible to freely make selections of two modes of the contact mode and the trigger mode when fasteners are driven. Therefore, it is possible to execute working without having a consciousness about the pressing of the gas combustion type driving tool against the workpiece and also without having a consciousness about the order of the operation of pulling the trigger lever. Accordingly, it is possible to freely set a form of the work in accordance with the circumstances.

When either the trigger switch or the contact switch is successively turned on after the combustion chamber has been opened, the combustion chamber may be closed and the fuel gas may be injected after a combustion chamber opening timer has been started and a period of time necessary for exhausting the combustion gas has been ensured.

In the above gas combustion type driving tool, in the case where the nails are continuously driven, after a period of time necessary for exhausting the combustion gas has been ensured by the combustion chamber opening timer, the combustion chamber is automatically closed and the fuel gas is injected and the ignition executed by the ignition plug is only waited. Therefore, it is possible to realize a gas combustion type driving tool, the working efficiency of which is high.

When both the trigger switch and the contact switch are turned off after the combustion chamber has been opened, a fan-off timer may be started so as to ensure a period of time necessary for exhausting the combustion gas and then a fan may be stopped.

In the above gas combustion type driving tool, in the case where an interval is generated between the completion of the first nail driving and the start of the next nail driving, it is unnecessary to rotate the fan uselessly. Therefore, it is possible to realize a gas combustion type driving tool in which energy can be saved.

Other aspects and advantages of the invention will be apparent from the following description, the drawings and the claims.

BRIEF DESCRIPTION OF DRAWINGS

FIG. 2(*b*) is a schematic illustration showing a state in which the combustion chamber is closed in the contact mode. FIG. 2(*c*) is a schematic illustration showing a state in which a driver is driven.

FIG. 6(*b*) is a schematic illustration showing a state in which combustion gas is exhausted when a combustion chamber is opened in the contact mode. FIG. 6(*c*) is a schematic illustration showing a state in which the combustion chamber is closed and fuel gas is injected in the contact mode.

FIG. 7(*b*) is a schematic illustration showing a state in which the combustion chamber is tightly closed in the trigger mode. FIG. 7(*c*) is a schematic illustration showing a state in which the driver is driven.

FIG. 8(*b*) is a schematic illustration showing a state in which combustion gas is exhausted when the combustion chamber is opened in the trigger mode. FIG. 8(*c*) is a schematic illustration showing a state in which the combustion chamber is closed and the fuel gas is injected in the trigger mode.

DESCRIPTION OF THE REFERENCE NUMERALS AND SIGNS

Figure 1:
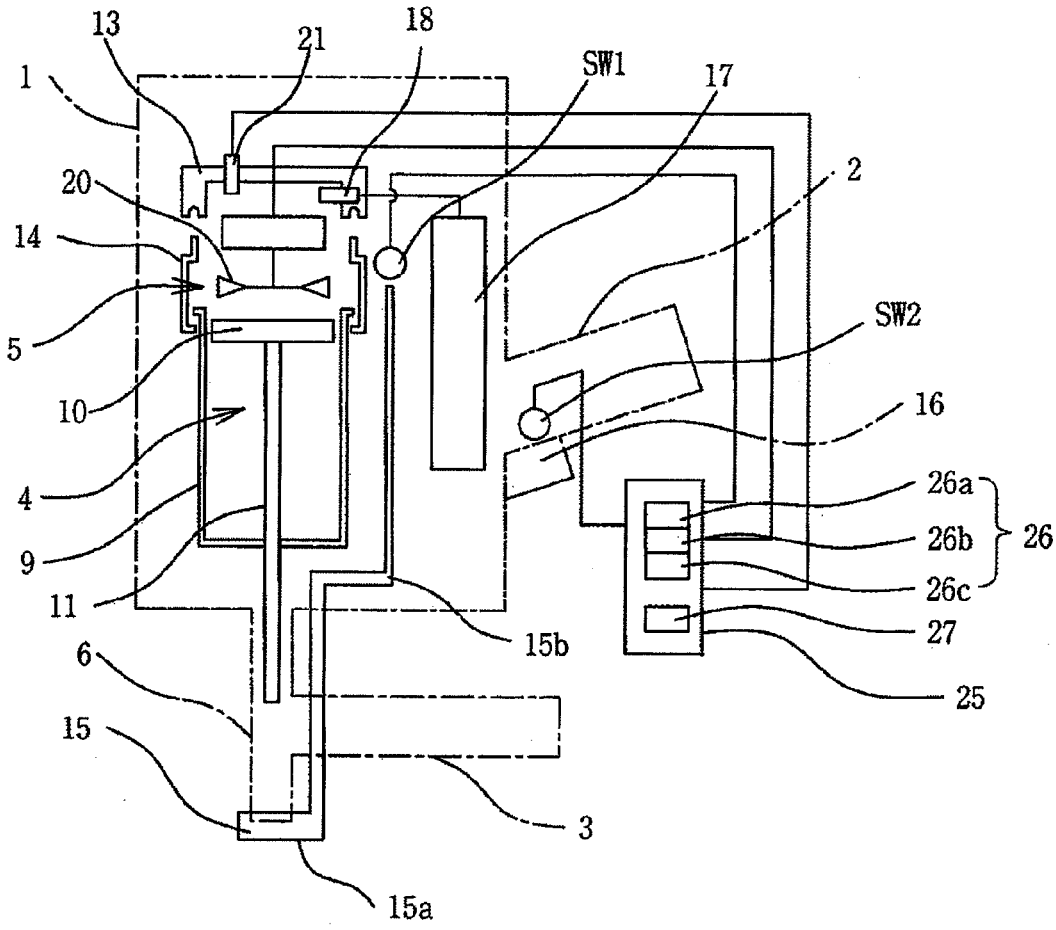
FIG. 1 is an arrangement view showing an outline of a gas combustion type driving tool of an embodiment of the present invention.

4 Driving piston and cylinder mechanism
5 Combustion chamber
6 Nose portion
9 Driving cylinder
10 Driving piston
11 driver
13 Cylinder head
14 Movable sleeve
15 Contact arm
16 Trigger lever
18 Injection nozzle
20 Rotary fan
21 Ignition plug
25 Control portion
26 Timer function
SW1 Contact switch
SW2 Trigger switch

BEST MODE FOR CARRYING OUT INVENTION

FIG. 1 is a conceptual view showing a gas combustion type driving tool of an exemplary embodiment of the present invention. A body 1 of a gas combustion type driving tool includes: a grip 2; a magazine 3 connected to the grip 2; a driving piston and cylinder mechanism 4; a combustion chamber 5; and a nose portion 6.

Nails or pins, which are fasteners, are charged into the magazine 3. By a mechanism not shown in the drawing, the nails or pins are sent to the nose portion 6 in order.

Figures 2A, 2B, 2C:
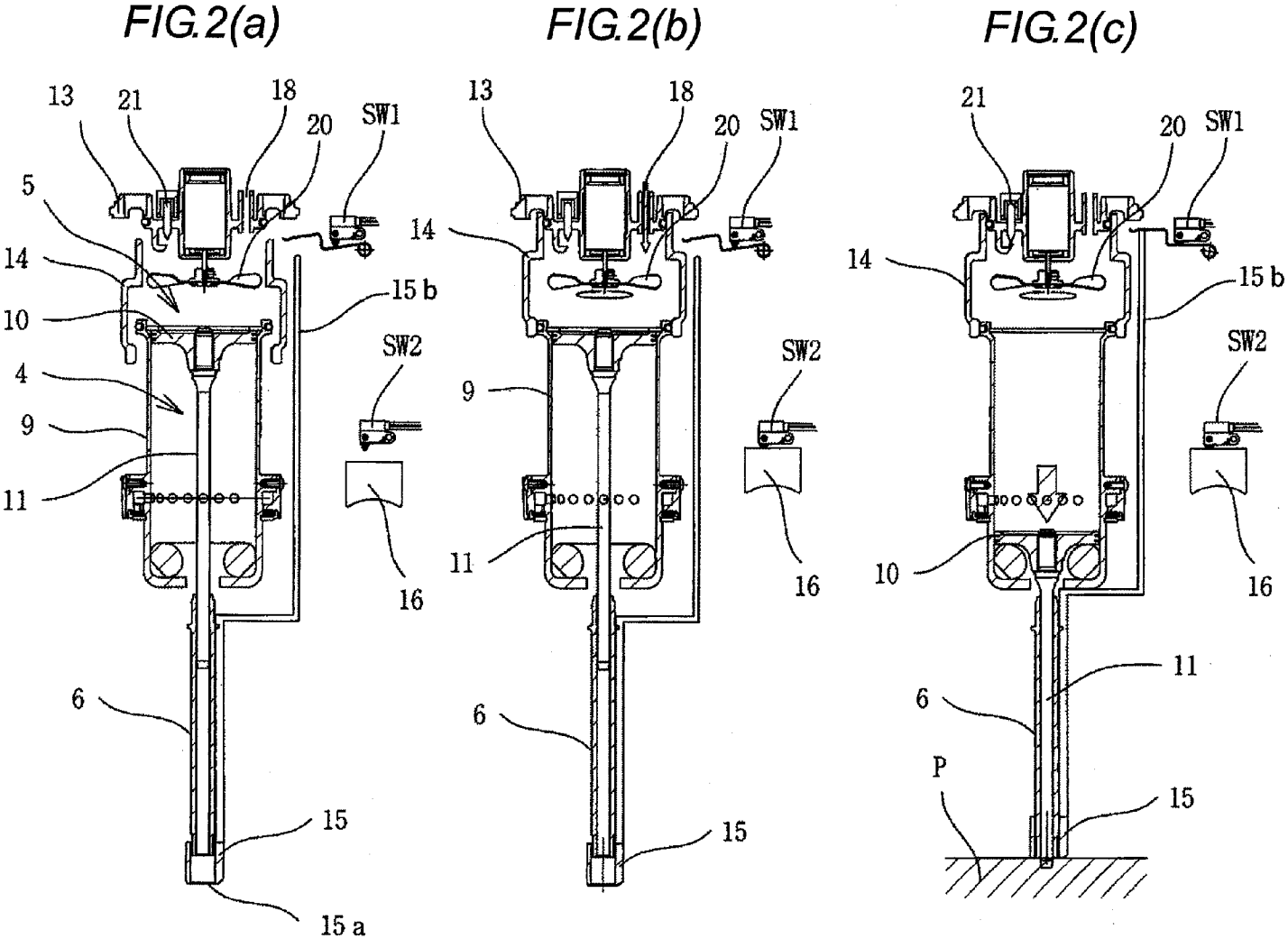
FIG. 2(*a*) is a schematic illustration showing a state in which a combustion chamber is opened in a contact mode.

As shown in FIG. 2(*a*), the driving piston and cylinder mechanism 4 includes a driving piston 10 which is slidably accommodated in the driving cylinder 9. The driving piston and cylinder mechanism 4 further includes a driver 11 which is integrally provided in a lower portion of the driving piston 10.

The combustion chamber 5 includes: an upper end face of the driving piston 10; a driving cylinder 9; a cylinder head 13 arranged in an upper portion of the body 1; and a cylindrical movable sleeve 14. As shown in FIG. 2(*b*), when the movable sleeve 14 is moved upward by an electric motor mechanism not shown in the drawing, the airtightly closed combustion chamber 5 is formed. On the other hand, when the movable sleeve 14 is moved downward, as shown in FIG. 2(*a*), the cylinder head 13 and the movable sleeve 14 are separated from each other and an upper portion of the combustion chamber 5 is communicated and opened to the atmosphere.

The contact arm 15 is provided so that it can be freely slid in the vertical direction along the nose portion 6. The lower end 15*a* of the contact arm 15 protrudes from the nose portion 6. As shown in FIG. 2(*c*), when the forward end portion 15*a* of the contact arm 15 is pressed against a workpiece P, into which a nail is driven, together with the nose portion 6, the contact arm 15 is moved upward relatively with respect to the nose portion 6. Therefore, an upper end portion of the lever 15*b* extending upward is engaged with the contact switch SW1, so that the contact switch SW1 can be electrically turned on.

This gas combustion type driving tool includes: a contact switch SW1 turned on and off when the contact arm 15 described above is moved in the vertical direction; a trigger switch SW2 electrically turned on when the trigger lever 16 is pulled; an injection nozzle 18 for injecting fuel gas, which is charged in the gas bomb 17, into the combustion chamber 5; a rotary fan 20 for stirring air in the combustion chamber 5 and forcibly exhausting the combustion gas generated after the combustion; an ignition plug 21 for igniting the mixed gas generated when air in the combustion chamber 5 and fuel gas are stirred by the rotary fan 20; an electric motor mechanism not shown for moving the movable sleeve 14 in the vertical direction; and a control portion 25 for controlling other components.

The control portion 25 includes MPU having a timer function 26 and a built-in memory 27. According to the control program stored in the built-in memory 27, this MPU judges states of the contact switch SW1 and the trigger switch SW2 and also judges the operation time of the timer 26 (the combustion chamber holding timer 26*a*, the fan-off timer 26*b* and the combustion chamber opening timer 26*c*) and controls the movable sleeve 14, the injection nozzle 18, the rotary fan 20 and the ignition plug 21.

Figure 3:
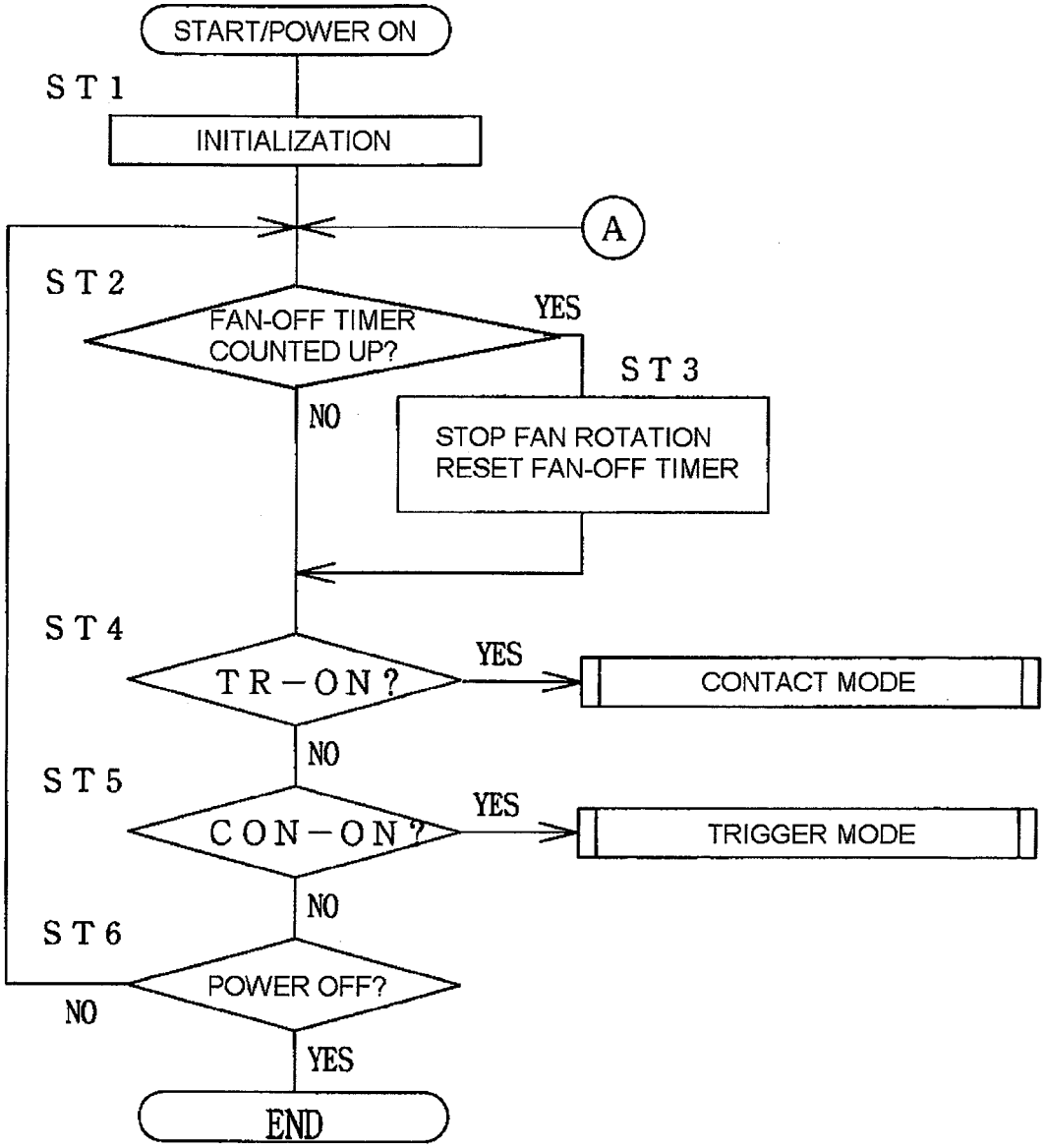
FIG. 3 is a flow chart for explaining an initial operation form of the above gas combustion type driving tool.
Figure 4:
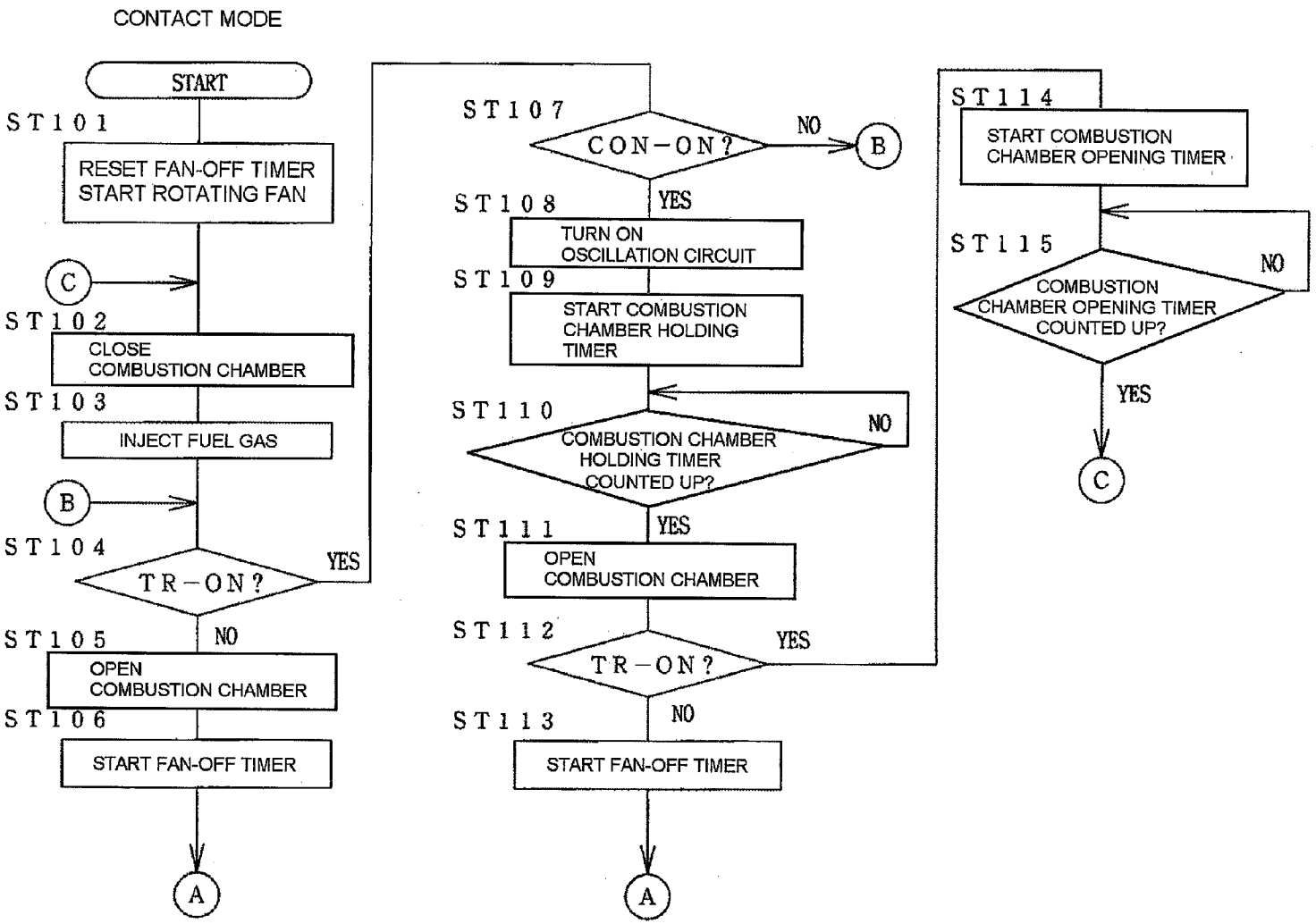
FIG. 4 is a flow chart for explaining an operation form of the contact mode of the above gas combustion type driving tool.
Figure 5:
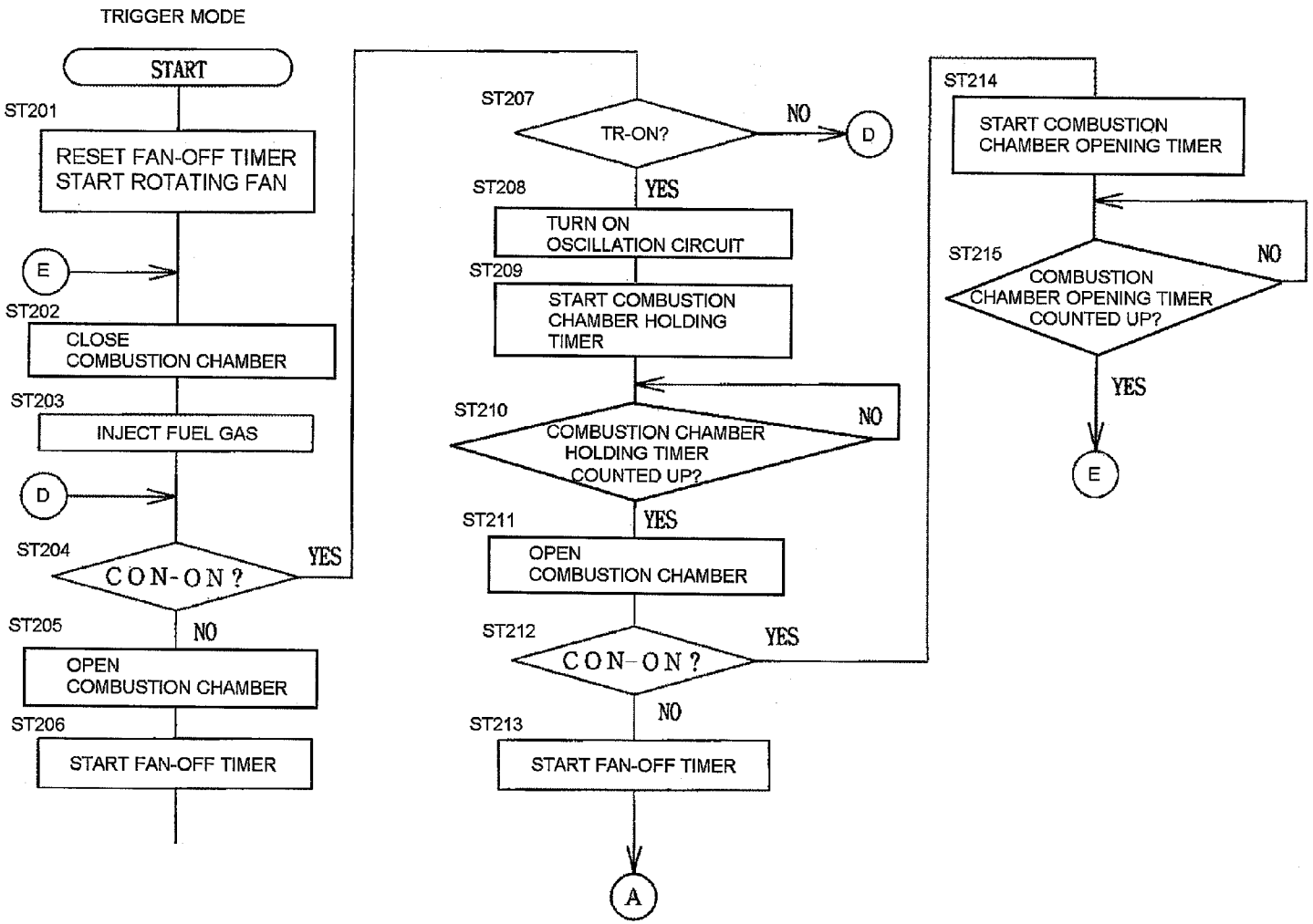
FIG. 5 is a flow chart for explaining an operation form of a trigger mode of the above gas combustion type driving tool.

Next, referring to the flow charts shown in FIGS. 3 to 5, an operation form of the gas combustion type driving tool composed as described above will be explained below.

When a worker turns on the electric power source so as to use the gas combustion type driving tool, the initialization is executed so that the electric circuit can be initialized (step ST1). In step ST2, the control portion 25 judges whether or not the fan-off timer 26*b* is counted up. Since the fan-off timer 26*b* is reset after the initialization, the program proceeds to step ST4 and the states of the trigger switch SW2 and the contact switch SW1 are checked. When it is in the middle of working, the rotary fan 20 is rotating. Therefore, if it is counted up, the rotary fan 20 is stopped in step ST3 and the fan-off timer 26*b* is reset and the program proceeds to step ST4.

In step ST4, it is judged by the trigger switch SW2 whether or not the worker pulls the trigger lever. When the trigger switch SW2 is turned on, the program proceeds to a routine of the contact mode. When the trigger switch SW2 is not turned on, the program proceeds to step ST5. Then, it is judged by the contact switch SW1 whether or not the worker has prepared for driving a nail by pressing the contact arm 15 against the workpiece P. In the case where the contact switch SW1 is turned on, the program proceeds to a routine of the trigger mode. Either the contact mode or the trigger mode can be carried out by whether the worker first pulls the trigger lever at the time of starting to drive a nail or the worker first presses the contact arm against the workpiece P.

In the case where either switch is not turned on, the steps ST2 to ST6 are looped until the electric power source is turned off and the program waits until the switch is turned on.

In the contact mode, in step ST101, the fan-off timer 26*b* is reset and the rotary fan 20 is rotated. Then, the program proceeds to step ST102 so as to move the movable sleeve 14 upward and close the combustion chamber 5. Concerning this matter, refer to FIG. 2(*b*).

After that, the injection nozzle 18 is opened for a predetermined period of time so that the fuel gas can be injected into the combustion chamber 5 which has been closed. Since the rotary fan 20 is rotating at this time, the fuel gas is stirred with air in the combustion chamber 5 and mixed gas is generated. In this way, the preparation for driving nails is completed (step ST103).

After the preparation for driving nails has been made, the control portion 25 judges whether the worker executes driving the nails or the worker interrupts driving a nail (step ST104).

In the case where the trigger switch SW2 is turned off, it is judged that the nail driving work is interrupted. As shown in FIG. 2(*a*), the movable sleeve 14 is moved downward and the combustion chamber 5 is opened (step ST105) so that the mixed gas can be forcibly discharged into the atmosphere. Then the fan-off timer 26*b* is started and the program is returned to step ST1.

This fan-off timer 26*b* is set so that the combustion gas can be completely exhausted. When a period of time (for example, 5 to 10 seconds), which is thought to be sufficiently long for forcibly exhausting the combustion gas by the rotary fan 20, is counted, the rotary fan 20 is stopped.

When the trigger switch SW2 is turned on in step ST104, it is judged that a nail driving motion is to be executed. Then, the program proceeds to step ST107 and it is waited that the contact switch SW1 is turned on, that is, it is waited that the worker presses the contact arm 15 against the workpiece P.

When the contact arm 15 is pressed against the workpiece P and the contact switch SW1 is turned on, the oscillating circuit is turned on (step ST108) and the ignition plug 21 is sparked so as to ignite the mixed gas. The mixed gas is explosively burned and as shown in FIG. 2(*c*), the driving piston 10 is moved downward by the pressure of combustion gas. Therefore, the nail is driven from the nose portion 6 into the workpiece P.

Figures 6A, 6B, 6C:
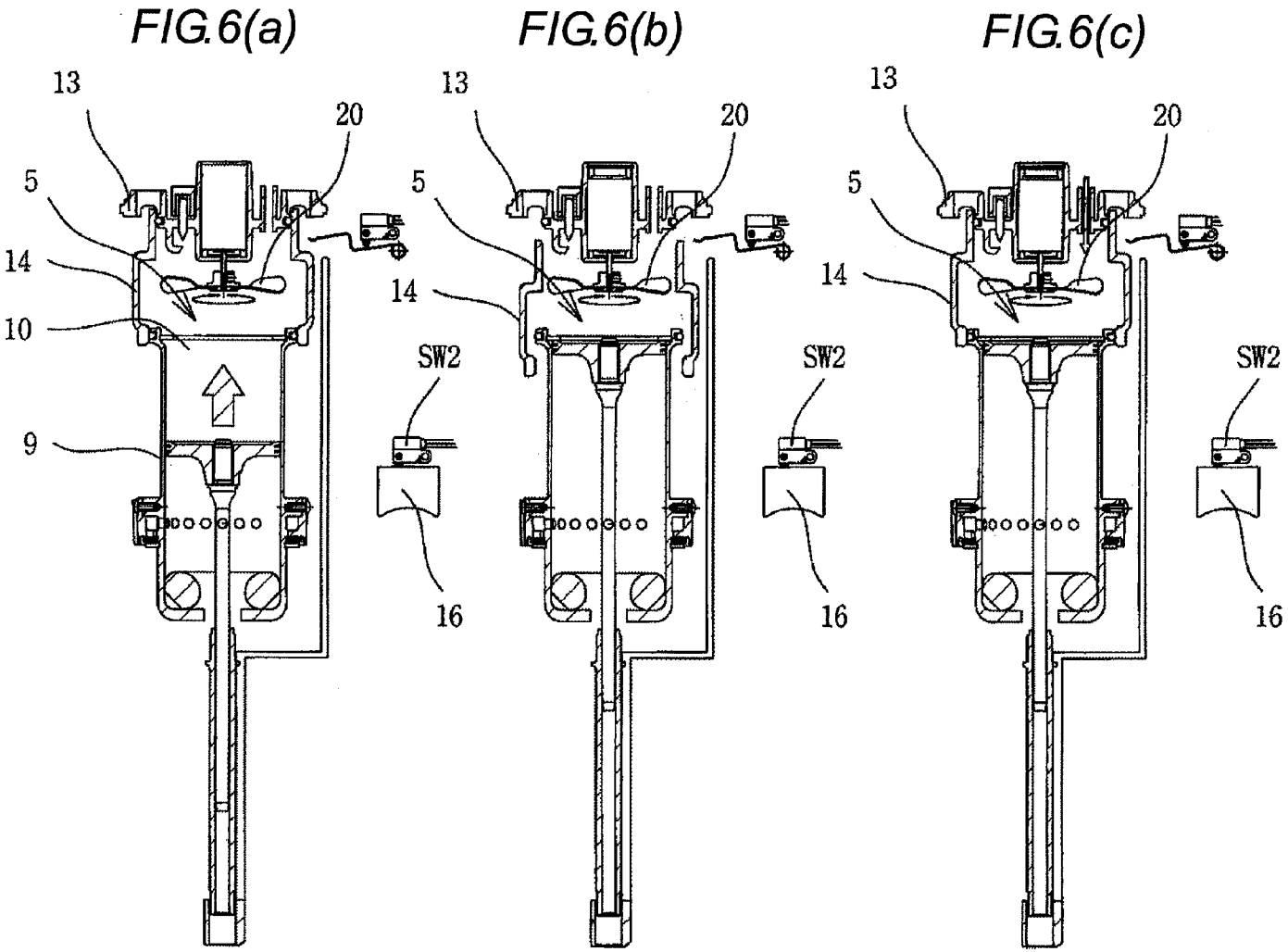
FIG. 6(*a*) is a schematic illustration for explaining a state in which a piston is moved upward after the completion of driving a nail in the contact mode.

After the ignition plug 21 has been sparked, the program proceeds to step ST109. The combustion chamber holding timer 26*a* is started and it is waited that the combustion chamber 5 is cooled and the pressure in the combustion chamber 5 becomes negative and the driving piston 10 is returned to the initial position. When the pressure in the combustion chamber 5 becomes negative, as shown in FIG. 6(*a*), the driving piston 10 is moved upward. When the combustion chamber holding timer 26*a* counts a period of time (not more than one second, preferably about 0.1 second) (the first period) in which the driving piston 10 is completely returned to the initial position, the program proceeds to step ST111 and the movable sleeve 14 is moved downward so as to open the combustion chamber 5 and the combustion gas is forcibly exhausted by the rotary fan 20. Concerning this matter, refer to FIG. 6(*b*).

At this point of time, a state of the trigger switch SW2 is judged (step ST112). In the case where the trigger switch SW2 is in a state of being turned on, it is judged that the nail driving motion is continuously executed. Then, the program proceeds to step ST114 and the combustion chamber opening timer 26*c* is started and it is waited that a predetermined period of time (the second period) is counted up (step ST115). When the second period is counted up, it is judged that the combustion gas is completely discharged from the combustion chamber 5 and replaced with fresh air. Then, the program is returned to step ST102 and the combustion chamber 5 is closed and the fuel gas is injected. Then, it is waited that the contact switch SW1 is turned on. Concerning this matter, refer to FIG. 6(*c*).

When the trigger switch SW2 is turned off in step ST112, it is judged that the nail driving is singly executed and the fan-off timer 26*b* is started and the program is returned to step ST1. Then, the program waits for the next operation in the state of FIG. 2(*a*).

In the trigger mode, the fan-off timer 26*b* is reset in step ST201 and the rotary fan 20 is rotated. Then, the program proceeds to step ST202 and the movable sleeve 14 is moved upward so as to close the combustion chamber 5.

After that, the program proceeds to step ST203 and the injection nozzle 18 is opened for a predetermined period of time so that the fuel gas can be injected into the combustion chamber 5 which has been closed. Since the rotary fan 20 is rotated at this point of time, the fuel gas is stirred with air in the combustion chamber 5 and the mixed gas is generated.

In this way, the preparation for driving a nail is completed. Concerning this matter, refer to FIG. 7(*b*).

When the preparation for driving nails is completed, the control portion 25 judges whether the worker starts driving the nails or the worker interrupts driving the nails (step ST204). When the contact switch SW1 is turned off, it is judged that the working is to be interrupted. Therefore, the movable sleeve 14 is moved downward and the combustion chamber 5 is opened (step ST205) so that the mixed gas can be forcibly discharged into the atmosphere. In this state, the fan-off timer 26*b* is started and the program is returned to step ST2 and the device waits for the next operation in the state shown in FIG. 7(*a*).

A sufficiently long period of time for exhausting the combustion gas is set on this fan-off timer 26*b*. When a period of time (for example, 5 to 10 seconds) (the third period), which is considered to be sufficiently long for forcibly discharging the combustion gas by the rotary fan 20 so that the combustion gas can be completely exhausted, is counted, the rotary fan 20 is stopped.

When the contact switch SW1 is turned on in ST204, it is judged that the nail driving is to be executed and the program proceeds to step ST207 and it is waited that the trigger switch SW2 is turned on, that is, it is waited that the worker pulls the trigger lever so that a nail can be driven into the workpiece P.

Figures 7A, 7B, 7C:
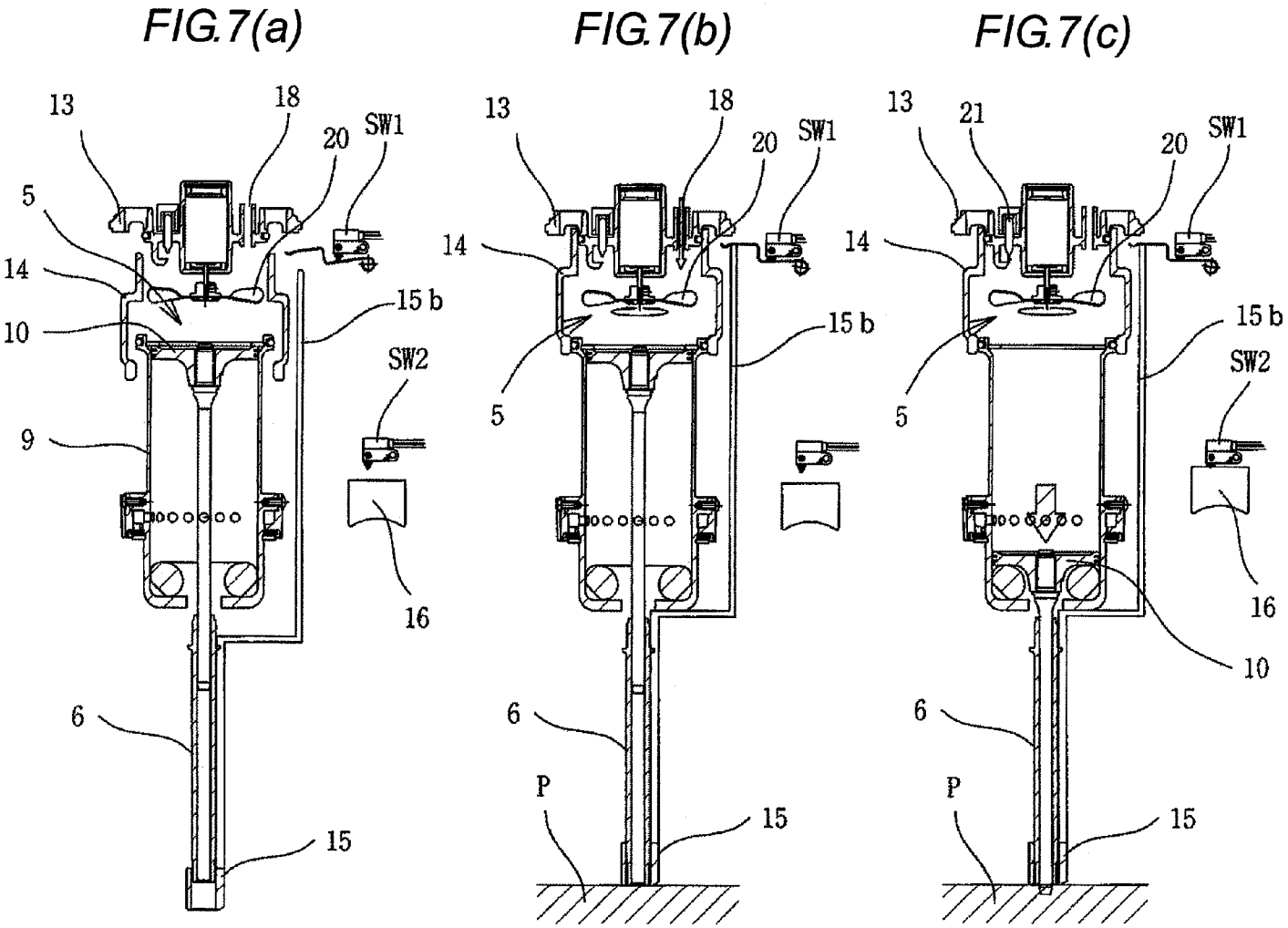
FIG. 7(*a*) is a schematic illustration showing a state in which the combustion chamber is opened in the trigger mode.

When the trigger lever 16 is pulled and the trigger switch SW2 is turned on, the oscillation circuit is turned on (step ST208) and the ignition plug 21 is sparked and the mixed gas is ignited. The mixed gas is explosively burned. As shown in FIG. 7(*c*), the driving piston 10 is moved downward by the pressure of combustion gas. Therefore, the nail is driven from the nose portion 6 into the workpiece P.

Figures 8A, 8B, 8C:
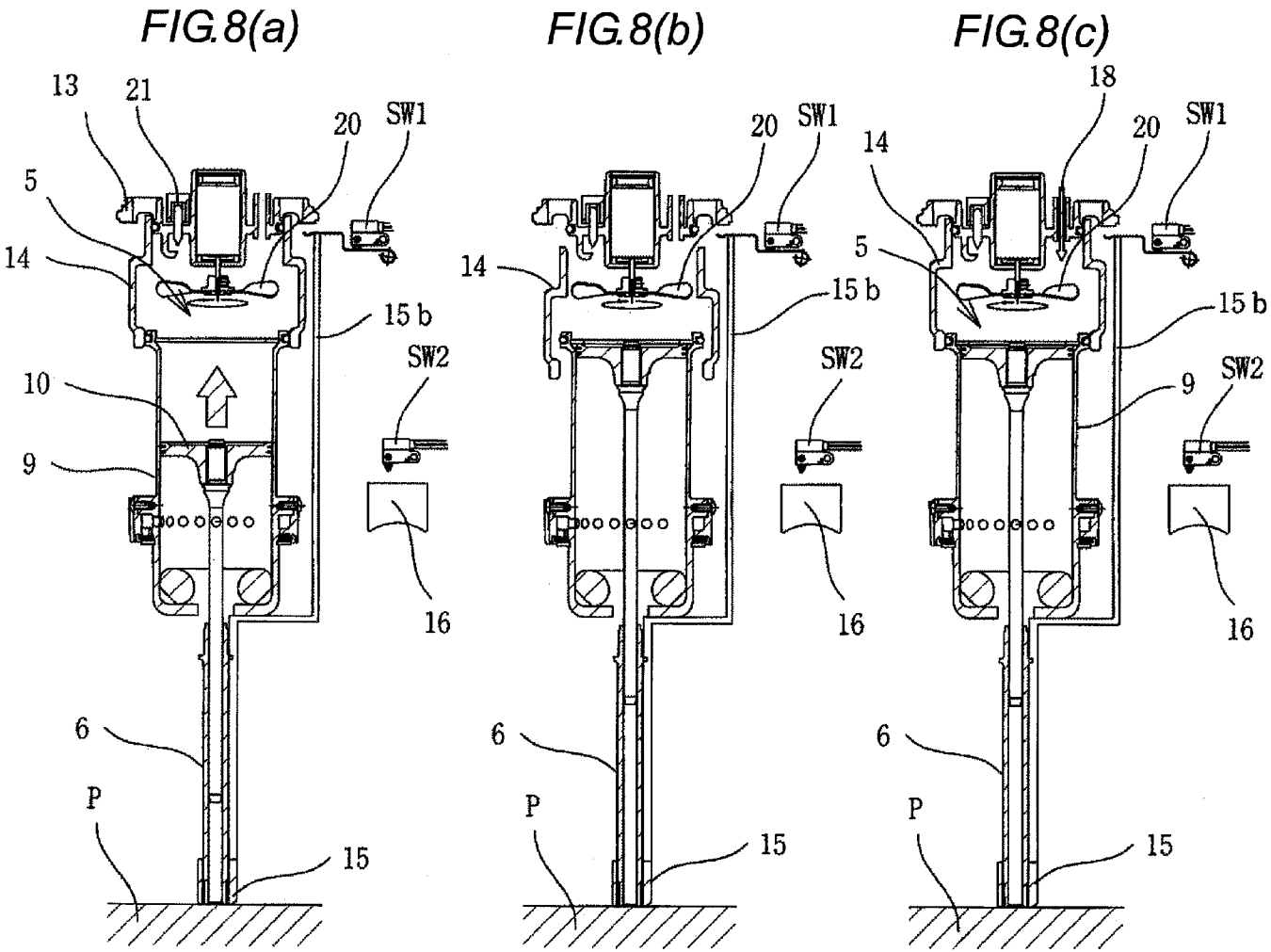
FIG. 8(*a*) is a schematic illustration showing a state in which the piston is moved upward after the completion of driving a nail in the trigger mode.

After the ignition plug 21 has been sparked, the program proceeds to step ST209. The combustion chamber holding timer 26*a* is started and it is waited that the combustion chamber 5 is cooled and the pressure in the combustion chamber 5 becomes negative and the driving piston 10 is returned to the initial position. When the pressure in the combustion chamber 5 becomes negative, as shown in FIG. 8(*a*), the driving piston 10 is moved upward. When the combustion chamber holding timer 26*a* counts a period of time (not more than one second, preferably about 0.1 second) (the first period) in which the driving piston 10 is completely returned to the initial position, the program proceeds to step ST211 and the movable sleeve 14 is moved downward so as to open the combustion chamber 5 and the combustion gas is forcibly exhausted by the rotary fan 20. Concerning this matter, refer to FIG. 8(*b*).

At this point of time, a state of the contact switch SW1 is judged (step ST212). In the case where the contact switch SW1 is in a state of being turned on, it is judged that the nail driving motion is continuously executed in which while the contact arm 15 is being pressed against the workpiece P, the nails are continuously driven by shifting the gas combustion type driving tool, that is, it is judged that a so-called shifting driving is executed. Then, the program proceeds to step ST214 and the combustion chamber opening timer 26*c* is started and it is waited that the timer is counted up (step ST215). After the timer has been counted up, the program returns to step ST202 and the combustion chamber 5 is closed and the fuel gas is injected into the combustion chamber 5. Then, it is waited that the trigger switch SW2 is turned on. Concerning this matter, refer to FIG. 8(*c*).

When the contact switch SW1 is turned off in step ST212, it is judged that the nail driving is singly executed. Therefore, the fan-off timer 26*b* is started and the program is returned to step ST2. Then, the program waits for the next operation in the state shown in FIG. 7(*a*).

As described above, even when the trigger lever 16 is pulled first or even when the contact arm 15 is pressed first against the workpiece, it is possible to make preparations for driving the nail. In the case of the contact mode, when the contact arm 15 is pressed against the workpiece P, the ignition plug 21 is sparked so that the nail can be driven.

In the case of the trigger mode, when the trigger lever 16 is pulled, the ignition plug 21 is sparked so that the nail can be driven. Further, when the trigger lever 16 is kept being pulled after the completion of driving the nail, after the driving piston 10 has been moved upward by the negative pressure in the combustion chamber 5, the combustion chamber 5 is opened, the combustion gas is exhausted, the combustion chamber 5 is closed and the fuel gas is injected, that is, preparations for driving the nail can be automatically made.

Therefore, the nails can be continuously driven. When the contact arm 15 is kept being pressed against the workpiece P after the completion of driving the nail, after the driving piston 10 has been moved upward by the negative pressure in the combustion chamber 5, the combustion chamber 5 is opened, the combustion gas is exhausted, the combustion chamber 5 is closed and the fuel gas is injected, that is, preparations for driving the nail can be automatically made. Therefore, the nails can be continuously driven by the shifting driving in which the nails are successively driven while the gas combustion type driving tool is being shifted on the workpiece P. As described above, according to the circumstances of working, the mode of driving the nails can be freely selected and the nails can be continuously driven by the selected mode. In this way, it is possible to realize a gas combustion type driving tool, the operation property and the working efficiency of which are excellent.

While description has been made in connection with specific exemplary embodiment of the invention, it will be obvious to those skilled in the art that various changes and modification may be made therein without departing from the present invention.

The present application is based on the Japanese Patent Application (No. 2006-328290) filed on Dec. 5, 2006, and the contents of which are hereby incorporated by reference.

INDUSTRIAL APPLICABILITY

The present invention can be applied to a gas combustion type driving tool.

The invention claimed is:

1. A The gas combustion type driving tool comprising:

a combustion chamber;

a trigger lever;

a contact arm;

a contact mode;

a trigger mode;

a trigger switch turned on to complete an electrical connection when the trigger lever is pulled;

a contact switch turned on to complete an electrical connection when the contact arm is pressed against the workpiece; and a combustion chamber opening timer, wherein in a first configuration the combustion chamber is closed, fuel gas is injected into the combustion chamber, air in the combustion chamber and the fuel gas are stirred to each other, and mixed gas is generated, when the trigger lever is pulled before the contact arm is pressed against a workpiece, wherein in a second configuration the mixed gas is ignited, when the contact arm is pressed against the workpiece into which a fastener is driven, and after the mixed gas is ignited and a first period has passed, the combustion chamber is opened and the combustion gas is exhausted, wherein, in the contact mode, the tool assumes the first configuration such that when the trigger lever is pulled, the combustion chamber is closed, the fuel gas is injected, the air in the combustion chamber and the fuel gas are stirred, and the mixed gas is generated before the contact arm is pressed against the workpiece, and the tool assumes the second configuration such that when the contact arm is pressed against the workpiece, the mixed gas is ignited, wherein, in the trigger mode, when the contact arm is pressed against the workpiece, the combustion chamber is closed the fuel gas is injected, the air in the combustion chamber and the fuel gas are stirred to each other, and mixed gas is generated, and when the trigger lever is pulled, the mixed gas is ignited, wherein, when either the trigger switch or the contact switch is successively turned on after the combustion chamber is opened, the combustion chamber is closed and the fuel gas is injected after the combustion chamber opening timer counts a second period.

2. A gas combustion type driving tool comprising:

a combustion chamber;

a trigger lever;

a contact arm;

a contact mode;

a trigger mode;

a trigger switch turned on to complete an electrical connection when the trigger lever is pulled;

a contact switch turned on to complete an electrical connection when the contact arm is pressed against the workpiece; and a fan-off timer, wherein in a first configuration the combustion chamber is closed, fuel gas is injected into the combustion chamber, air in the combustion chamber and the fuel gas are stirred to each other and mixed as is generated, when the trigger lever is pulled before the contact arm is pressed against a workpiece, wherein in a second configuration the mixed gas is ignited, when the contact arm is pressed against the workpiece into which a fastener is driven, and after the mixed gas is ignited and a first period has passed, the combustion chamber is opened and the combustion gas is exhausted, wherein, in the contact mode, the tool assumes the first configuration such that when the trigger lever is pulled, the combustion chamber is closed, the fuel gas is injected, the air in the combustion chamber and the fuel gas are stirred, and the mixed gas is generated before the contact arm is pressed against the workpiece, and the tool assumes the second configuration such that when the contact arm is pressed against the workpiece, the mixed gas is ignited, wherein, in the trigger mode, when the contact arm is pressed against the workpiece, the combustion chamber is closed, the fuel gas is injected, the air in the combustion chamber and the fuel gas are stirred to each other, and mixed gas is generated, and when the trigger lever is pulled, the mixed gas is ignited, wherein, when both the trigger switch and the contact switch are turned off after the combustion chamber is opened, a fan is stopped after the fan-off timer counts a third period.

3. A gas combustion type driving tool comprising:

a combustion chamber;

a trigger lever;

a contact arm;

a contact mode;

a trigger mode;

a movable sleeve for opening and closing the combustion chamber;

an ignition plug for igniting the mixed gas;

an injection nozzle for injecting the fuel gas into the combustion chamber;

a trigger switch turned on to complete an electrical connection when the trigger lever is pulled;

a contact switch turned on to complete an electrical connection when the contact arm is pressed against the workpiece; and a control portion, wherein in a first configuration the combustion chamber is closed, fuel gas is injected into the combustion chamber, air in the combustion chamber and the fuel gas are stirred to each other, and mixed gas is generated, when the trigger lever is pulled before the contact arm is pressed against a workpiece, wherein in a second configuration the mixed gas is ignited, when the contact arm is pressed against the workpiece into which a fastener is driven, and after the mixed gas is ignited and a first period has passed, the combustion chamber is opened and the combustion gas is exhausted, wherein, in the contact mode, the tool assumes the first configuration such that when the trigger lever is pulled, the combustion chamber is closed, the fuel gas is injected, the air in the combustion chamber and the fuel gas are stirred, and the mixed gas is generated before the contact arm is pressed against the workpiece, and the tool assumes the second configuration such that when the contact arm is pressed against the workpiece, the mixed gas is ignited, wherein, in the trigger mode, when the contact arm is pressed against the workpiece, the combustion chamber is closed, the fuel gas is injected, the air in the combustion chamber and the fuel gas are stirred to each other, and mixed gas is generated, and when the trigger lever is pulled, the mixed gas is ignited, wherein the control portion is configured so that when the control portion detects that the trigger switch is turned on and the contact mode is selected, the movable sleeve is operated so as to close the combustion chamber, the injection nozzle is operated so as to inject fuel gas into the combustion chamber for making preparations for driving a nail into the workpiece, and when it is detected that the contact switch is turned on after a completion of making preparations for driving the nail, the ignition plug is operated, and the control portion is configured so that when the control portion detects that the contact switch is turned on and the trigger mode is selected, the movable sleeve is operated so as to close the combustion chamber, the injection nozzle is operated so as to inject fuel gas into the combustion chamber for making preparations for driving the nail into the workpiece, and when it is detected that the trigger switch is turned on after the completion of making preparations for driving the nail, the ignition plug is operated.

* * * * *